US011815839B2

(12) United States Patent
Oba et al.

(10) Patent No.: US 11,815,839 B2
(45) Date of Patent: Nov. 14, 2023

(54) IMAGE FORMING APPARATUS CAPABLE OF ADJUSTING IMAGE FORMING CONDITION ACCURATELY, AND IMAGE FORMING CONDITION ADJUSTMENT METHOD

(71) Applicant: KYOCERA Document Solutions Inc., Osaka (JP)

(72) Inventors: Keisuke Oba, Osaka (JP); Masaru Watanabe, Osaka (JP); Yasuaki Sakamoto, Osaka (JP); Kanako Kikuchi, Osaka (JP); Ayato Morikami, Osaka (JP); Yuki Nakaiwa, Osaka (JP); Koji Uno, Osaka (JP); Takuji Watanabe, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/932,620

(22) Filed: Sep. 15, 2022

(65) Prior Publication Data

US 2023/0080093 A1 Mar. 16, 2023

(30) Foreign Application Priority Data

Sep. 16, 2021 (JP) ..... 2021-150808

(51) Int. Cl.
*G03G 15/00* (2006.01)

(52) U.S. Cl.
CPC ..... *G03G 15/5054* (2013.01); *G03G 15/5058* (2013.01)

(58) Field of Classification Search
CPC ..... G03G 15/5054; G03G 15/5058
See application file for complete search history.

(56) References Cited

U.S. PATENT DOCUMENTS

2012/0134702 A1* 5/2012 Fujiwara ..... G03G 15/5058 399/72
2012/0189332 A1* 7/2012 Fukao ..... G03G 15/5058 399/49
2018/0292776 A1* 10/2018 Ino ..... G03G 15/5058
2021/0141321 A1* 5/2021 Kimura ..... G03G 15/5058

FOREIGN PATENT DOCUMENTS

JP 2008040462 A 2/2008

* cited by examiner

*Primary Examiner* — Sandra Brase
(74) *Attorney, Agent, or Firm* — Alleman Hall Creasman & Tuttle LLP

(57) ABSTRACT

An image forming apparatus includes a transfer processing portion, a detection processing portion, a correction processing portion, and an adjustment processing portion. The transfer processing portion transfers a detection toner image to outside an output area of a transfer object to which a toner image as an output target is transferred from an image-carrying member. The detection processing portion detects a density of the detection toner image that has been transferred to the transfer object by the transfer processing portion. The correction processing portion corrects a detection result of the detection processing portion based on an amount of toner transferred from the image-carrying member to the output area at a transfer timing when the detection toner image is transferred. The adjustment processing portion adjusts an image forming condition based on the detection result after correction by the correction processing portion.

5 Claims, 5 Drawing Sheets

IMAGE FORMING APPARATUS CAPABLE OF ADJUSTING IMAGE FORMING CONDITION ACCURATELY, AND IMAGE FORMING CONDITION ADJUSTMENT METHOD

INCORPORATION BY REFERENCE

This application is based upon and claims the benefit of priority from the corresponding Japanese Patent Application No. 2021-150808 filed on Sep. 16, 2021, the entire contents of which are incorporated herein by reference.

BACKGROUND

The present disclosure relates to an image forming apparatus and an image forming condition adjustment method executed in an image forming apparatus.

An electrophotographic image forming apparatus includes a transfer portion, such as a primary transfer roller, that, upon receiving a supply of a predetermined transfer current, transfers a toner image formed on an image-carrying member, such as a photoconductor drum, to a transfer object, such as an intermediate transfer belt.

In addition, there is known an image forming apparatus that transfers a predetermined detection toner image to outside an output area of the transfer object to which a toner image as an output target is transferred from the image-carrying member, and adjusts an image forming condition based on the detected density of the detection toner image.

SUMMARY

An image forming apparatus according to an aspect of the present disclosure includes a transfer portion, a transfer processing portion, a detection processing portion, a correction processing portion, and an adjustment processing portion. The transfer portion, upon receiving a supply of a predetermined transfer current, transfers a toner image formed on an image-carrying member to a transfer object. The transfer processing portion transfers a predetermined detection toner image to outside an output area of the transfer object to which the toner image as an output target is transferred from the image-carrying member. The detection processing portion detects a density of the detection toner image that has been transferred to the transfer object by the transfer processing portion. The correction processing portion corrects a detection result of the detection processing portion based on an amount of toner transferred from the image-carrying member to the output area at a transfer timing when the transfer processing portion transfers the detection toner image. The adjustment processing portion adjusts an image forming condition based on the detection result after correction by the correction processing portion.

An image forming condition adjustment method according to another aspect of the present disclosure is executed in an image forming apparatus including a transfer portion configured to, upon receiving a supply of a predetermined transfer current, transfer a toner image formed on an image-carrying member to a transfer object, and includes a transfer step, a detection step, a correction step, and an adjustment step. The transfer step transfers a predetermined detection toner image to outside an output area of the transfer object to which the toner image as an output target is transferred from the image-carrying member. The detection step detects a density of the detection toner image that has been transferred to the transfer object by the transfer step. The correction step corrects a detection result of the detection step based on an amount of toner transferred from the image-carrying member to the output area at a transfer timing when the transfer step transfers the detection toner image. The adjustment step adjusts an image forming condition based on the detection result after correction by the correction step.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 100]

First, a configuration of an image forming apparatus 100 according to an embodiment of the present embodiment is described with reference to FIG. 1 and FIG. 2.

Figure 1:
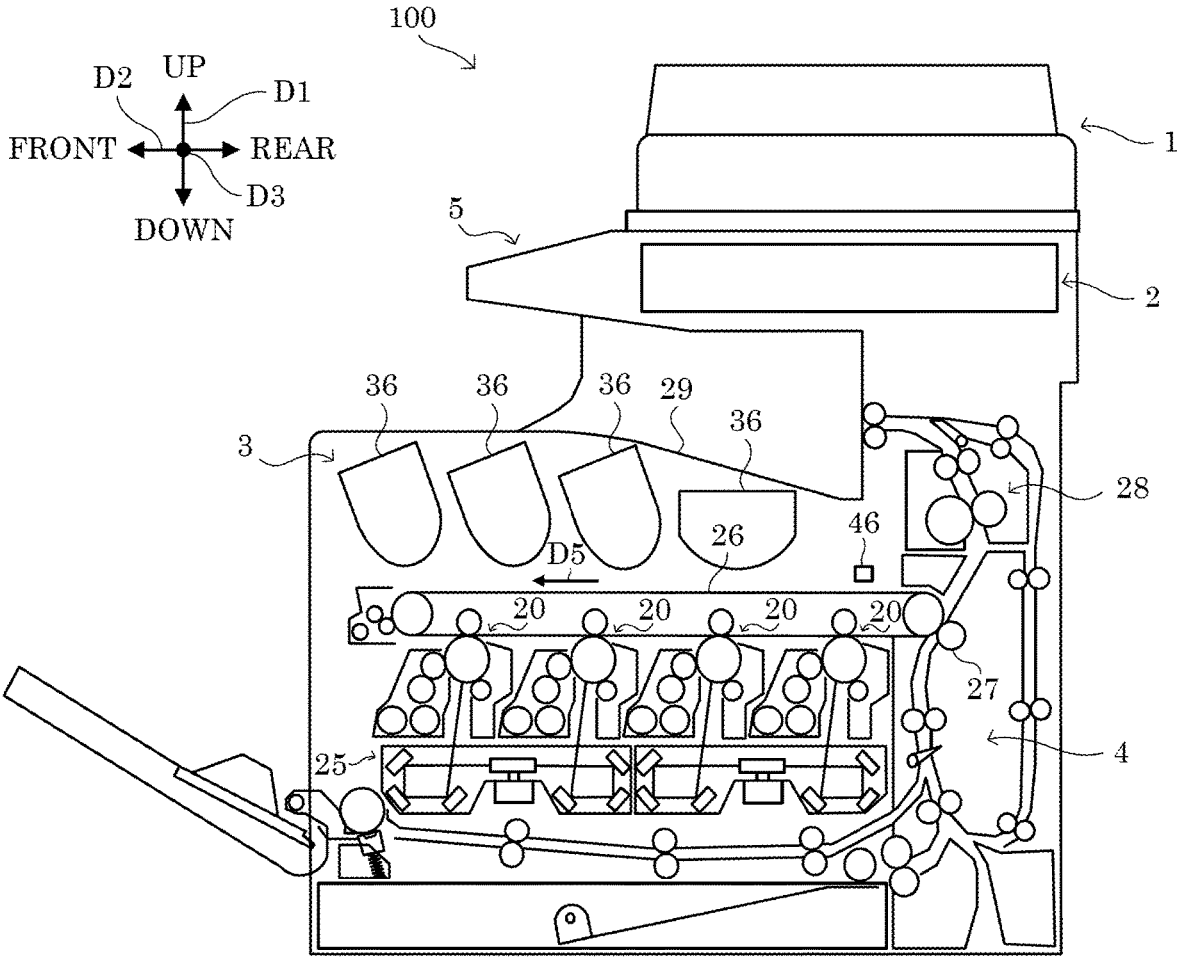
FIG. 1 is a cross section diagram showing a configuration of an image forming apparatus according to an embodiment of the present disclosure.

It is noted that for the sake of explanation, an up-down direction D1 is defined as a vertical direction in a state where the image forming apparatus 100 is installed usably (the state shown in FIG. 1). In addition, a front-rear direction D2 is defined on the supposition that the left-side surface of the image forming apparatus 100 shown in FIG. 1 is a front side (front). Furthermore, a left-right direction D3 is defined based on the image forming apparatus 100 in the installation state viewed from the front side.

The image forming apparatus 100 is a multifunction peripheral having a plurality of functions such as a scan function for reading an image of a document sheet, a print function for forming an image based on image data, a facsimile function, and a copy function. It is noted that the present disclosure is applicable to image forming apparatuses, such as a printer, a facsimile device, and a copier, that can form an image by an electrophotographic method.

Figure 2:
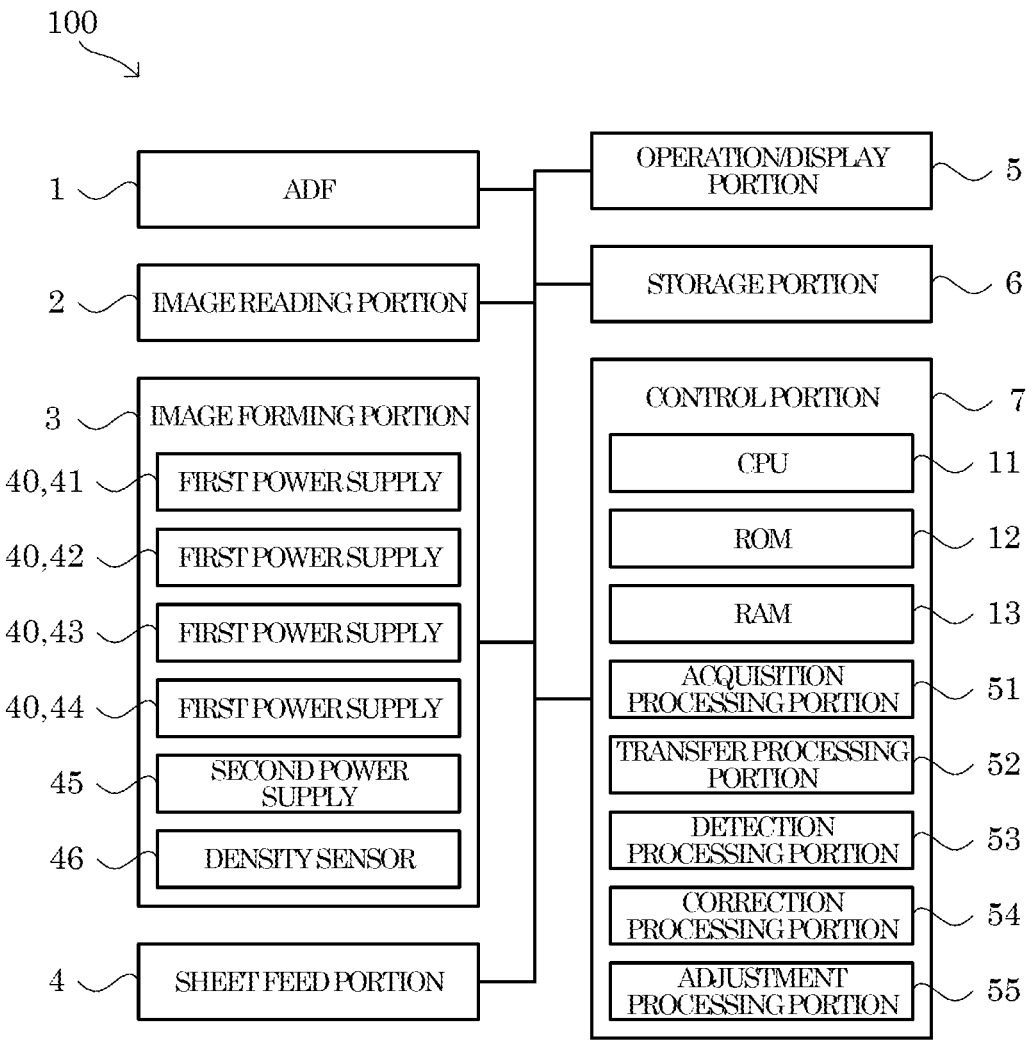
FIG. 2 is a block diagram showing a system configuration of the image forming apparatus according to the embodiment of the present disclosure.

As shown in FIG. 1 and FIG. 2, the image forming apparatus 100 includes an ADF (Auto Document Feeder) 1, an image reading portion 2, an image forming portion 3, a sheet feed portion 4, an operation/display portion 5, a storage portion 6, and a control portion 7.

The ADF 1 conveys a document sheet that is a reading object to be read by the scan function. The ADF 1 includes a document sheet setting portion, a plurality of conveyance rollers, a document sheet pressing member, and a sheet discharge portion.

The image reading portion 2 realizes the scan function. The image reading portion 2 includes a document sheet table, a light source, a plurality of mirrors, an optical lens, and a CCD (Charge Coupled Device).

The image forming portion 3 realizes the print function. Specifically, the image forming portion 3 forms a color or monochrome image on a sheet supplied from the sheet feed portion 4.

The sheet feed portion 4 supplies a sheet to the image forming portion 3. The sheet feed portion 4 includes a sheet feed cassette, a manual feed tray, and a plurality of conveyance rollers.

The operation/display portion 5 is a user interface of the image forming apparatus 100. The operation/display portion 5 includes a display portion and an operation portion, wherein the display portion, such as a liquid crystal display, is configured to display a variety of information in response to control instructions from the control portion 7, and the operation portion, such as operation keys or a touch panel, is configured to input a variety of information to the control portion 7 in response to user operations.

The storage portion 6 is a nonvolatile storage device. For example, the storage portion 6 is a nonvolatile memory such as a flash memory. It is noted that the storage portion 6 may be a SSD (Solid State Drive) or a HDD (Hard Disk Drive).

The control portion 7 comprehensively controls the image forming apparatus 100. As shown in FIG. 2, the control portion 7 includes a CPU 11, a ROM 12, and a RAM 13. The CPU 11 is a processor that executes various types of calculation processes. The ROM 12 is a nonvolatile storage device in which are preliminarily stored various types of information such as control programs for causing the CPU 11 to execute various processes. The RAM 13 is a volatile or nonvolatile storage device that is used as a temporary storage memory (working area) for the various types of processes executed by the CPU 11. The CPU 11 comprehensively controls the image forming apparatus 100 by executing the various types of control programs that are preliminarily stored in the ROM 12.

It is noted that the control portion 7 may be a control portion that is provided separately from a main control portion that comprehensively controls the image forming apparatus 100. In addition, the control portion 7 may be composed of an electronic circuit such as an integrated circuit (ASIC)

[Configuration of Image Forming Portion 3]

Figure 3:
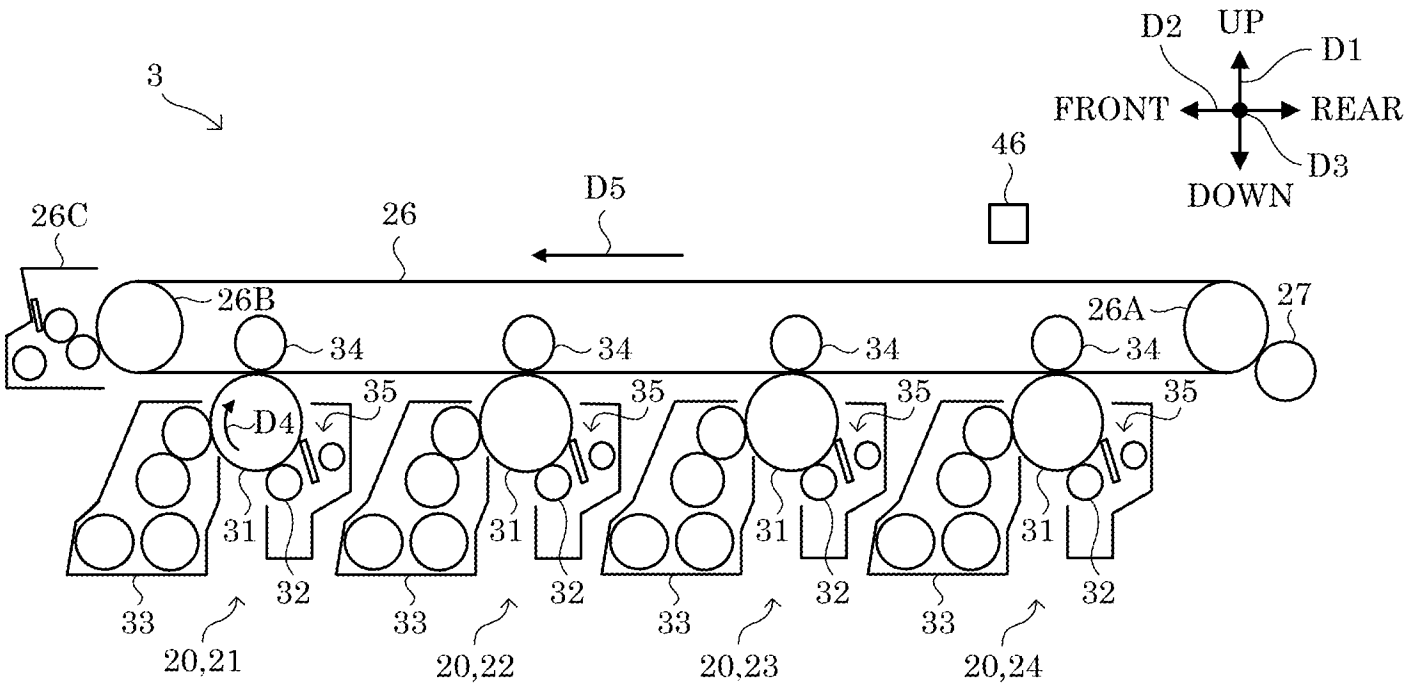
FIG. 3 is a cross section diagram showing a configuration of an image forming portion of the image forming apparatus according to the embodiment of the present disclosure.
Figure 4:
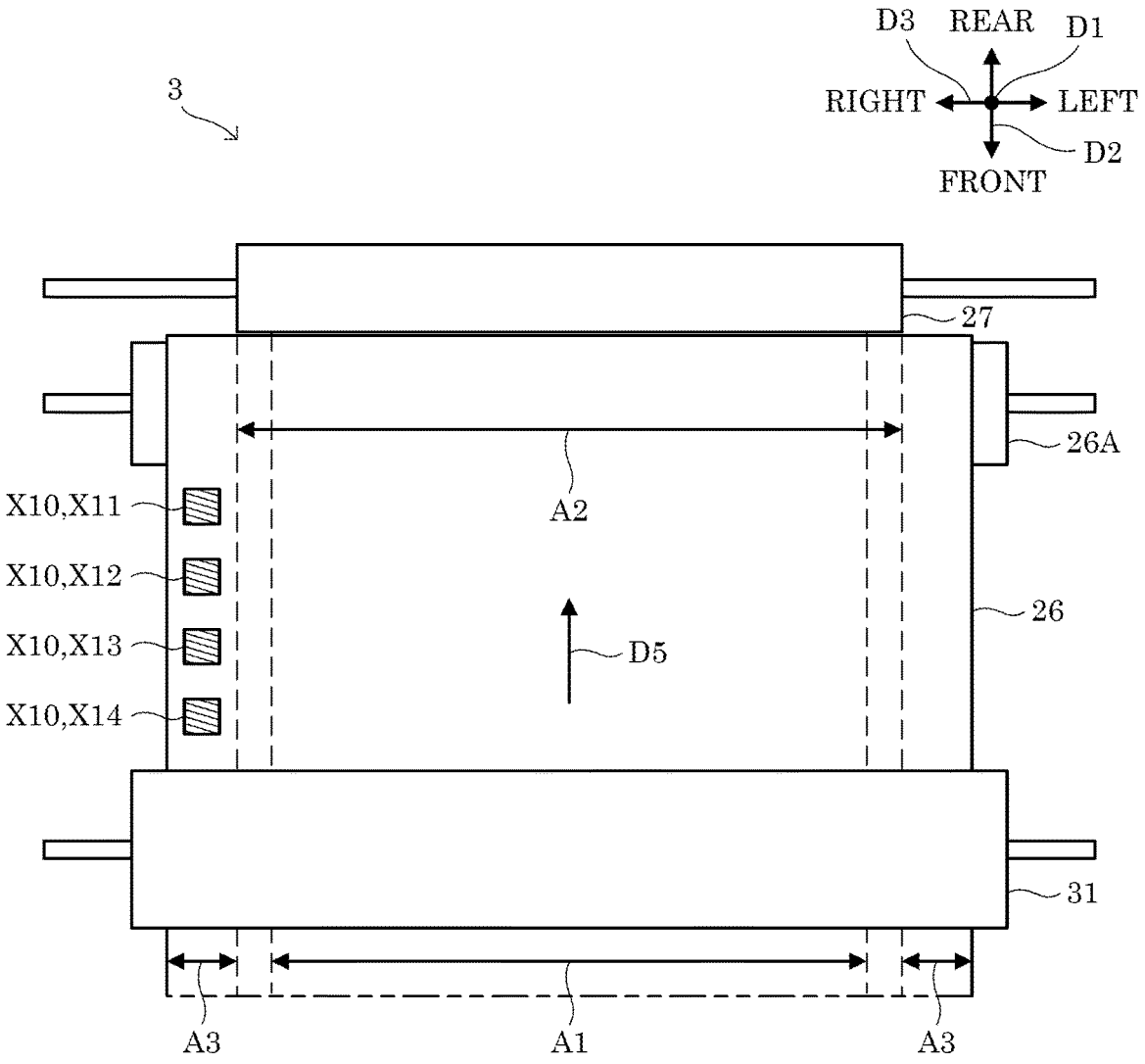
FIG. 4 is a bottom surface diagram showing a configuration of an intermediate transfer belt of the image forming apparatus according to the embodiment of the present disclosure.
Figure 5:
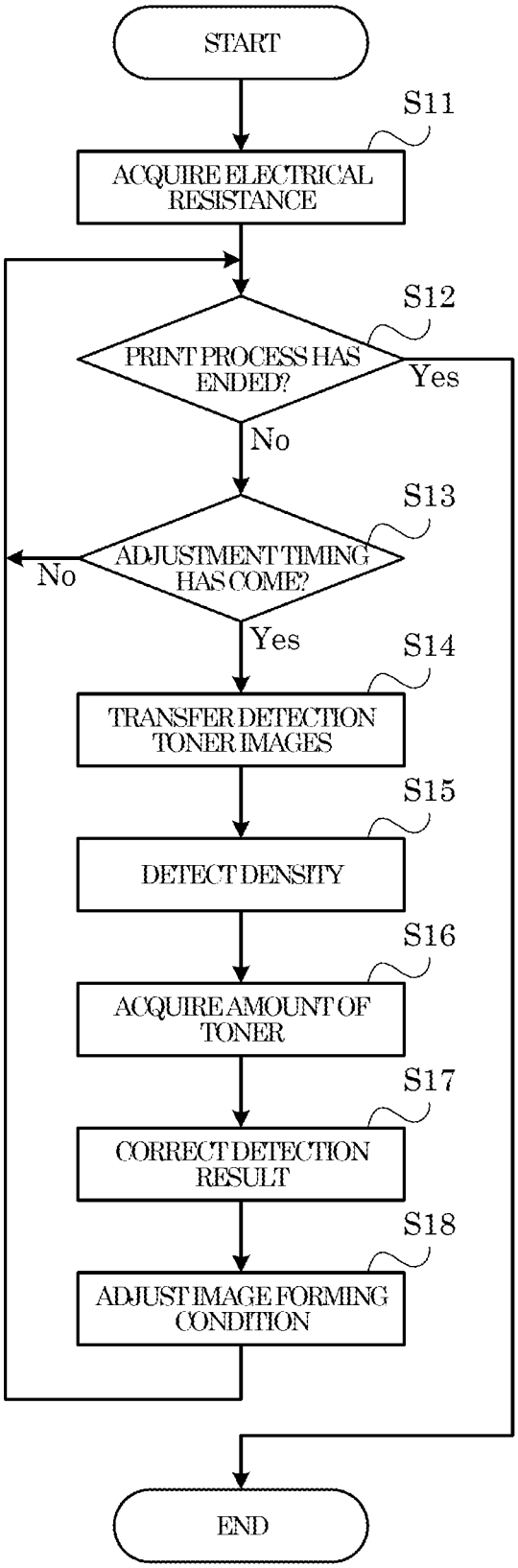
FIG. 5 is a flowchart showing an example of a condition adjustment process executed in the image forming apparatus according to the embodiment of the present disclosure.

Next, with reference to FIG. 1 to FIG. 4, a configuration of the image forming portion 3 is described. Here, FIG. 3 is a cross section diagram showing a configuration of a plurality of image forming units 20, an intermediate transfer belt 26, and a secondary transfer roller 27. In addition, FIG. 4 is a bottom surface diagram showing a configuration of a photoconductor drum 31 of an image forming unit 24, the intermediate transfer belt 26, a drive roller 26A, and the secondary transfer roller 27.

As shown in FIG. 1, the image forming portion 3 includes four image forming units 20, an optical scan device 25, the intermediate transfer belt 26, the secondary transfer roller 27, a fixing device 28, and a sheet discharge tray 29. In addition, as shown in FIG. 2, the image forming portion 3 includes four first power supplies 40, a second power supply 45, and a density sensor 46.

Among the four image forming units 20, an image forming unit 21 (see FIG. 3) forms a Y (yellow) toner image. Among the four image forming units 20, an image forming unit 22 (see FIG. 3) forms a C (cyan) toner image. Among the four image forming units 20, an image forming unit 23 (see FIG. 3) forms a M (magenta) toner image. Among the four image forming units 20, an image forming unit 24 (see FIG. 3) forms a K (black) toner image. As shown in FIG. 1 and FIG. 3, the four image forming units 20 are aligned along the front-rear direction D2, in the order of yellow, cyan, magenta, and black from the front side of the image forming apparatus 100.

As shown in FIG. 3, each of the image forming units 20 includes a photoconductor drum 31, a charging roller 32, a developing device 33, a primary transfer roller 34, and a drum cleaning portion 35. In addition, each of the image forming units 20 includes a toner container 36 shown in FIG. 1.

On the surface of the photoconductor drum 31, an electrostatic latent image is formed. For example, the photoconductor drum 31 includes a photosensitive layer formed from amorphous silicon. Upon receiving a rotational driving force supplied from a motor (not shown), the photoconductor drum 31 rotates in a drum rotation direction D4 shown in FIG. 3. This allows the photoconductor drum 31 to convey the electrostatic latent image formed on its surface.

The charging roller 32 electrically charges the surface of the photoconductor drum 31 upon receiving an application of a predetermined charging voltage. For example, the charging roller 32 electrically charges the surface of the photoconductor drum 31 to a positive polarity. The optical scan device 25 irradiates light based on image data to the surface of the photoconductor drum 31 that has been electrically charged by the charging roller 32. This forms an electrostatic latent image on the surface of the photoconductor drum 31.

The developing device 33 develops the electrostatic latent image formed on the surface of the photoconductor drum 31. The developing device 33 includes a pair of stirring members, a magnet roller, and a developing roller. The pair of stirring members stir developer stored in the developing device 33, wherein the developer includes toner and carrier. For example, the toner included in the developer is charged with positive polarity by friction between the toner and the carrier included in the developer. The magnet roller draws up the developer stirred by the pair of stirring members and supplies the toner included in the developer to the developing roller. The developing roller conveys the toner supplied from the magnet roller to a position facing the photoconductor drum 31. In addition, upon receiving an application of a predetermined developing bias voltage, the developing roller supplies the toner conveyed to the position facing the photoconductor drum 31, to the photoconductor drum 31. This allows the toner to be selectively supplied to an exposure area of the photoconductor drum 31 to which the light has been irradiated by the optical scan device 25, so that the electrostatic latent image formed on the surface of the photoconductor drum 31 is developed. It is noted that the developing device 33 receives a supply of the toner from the toner container 36.

The primary transfer roller 34, upon receiving a supply of a predetermined primary transfer current, transfers a toner image formed on the surface of the photoconductor drum 31 to an outer peripheral surface of the intermediate transfer belt 26. As shown in FIG. 3, the primary transfer roller 34 is disposed to face the photoconductor drum 31 across the intermediate transfer belt 26. The primary transfer roller 34 is an example of a transfer portion of the present disclosure. In addition, the primary transfer current is an example of a transfer current of the present disclosure. In addition, the photoconductor drum 31 is an example of an image-carrying member of the present disclosure. In addition, the intermediate transfer belt 26 is an example of a transfer object of the present disclosure.

The drum cleaning portion 35 removes the toner that has remained on the surface of the photoconductor drum 31 after the toner image transfer performed by the primary transfer roller 34.

The optical scan device 25 emits light based on the image data, to the surfaces of the photoconductor drums 31 of the image forming units 20.

The intermediate transfer belt 26 is a belt member in an endless shape to which toner images formed on the surfaces of the photoconductor drums 31 of the image forming units 20 are transferred. For example, the intermediate transfer belt 26 is formed from a resin material such as polyimide. The intermediate transfer belt 26 is stretched by the drive roller 26A (see FIG. 3) and a stretch roller 26B (see FIG. 3) with a predetermined tension. The intermediate transfer belt 26 rotates in a belt rotation direction D5 shown in FIG. 3 when the drive roller 26A rotates upon receiving a rotational driving force supplied from a motor (not shown). This allows the intermediate transfer belt 26 to convey the toner image transferred from each of the photoconductor drums 31, to a transfer position where the toner image is transferred to a sheet by the secondary transfer roller 27. It is noted that the outer peripheral surface of the intermediate transfer belt 26 from which the toner image has been transferred by the secondary transfer roller 27 is cleaned by a belt cleaning portion 26C (see FIG. 3). The intermediate transfer belt 26 is an example of an image conveying member of the present disclosure.

The secondary transfer roller 27, upon receiving a supply of a predetermined secondary transfer current, transfers the toner image that has been transferred to the outer peripheral surface of the intermediate transfer belt 26, to a sheet supplied from the sheet feed portion 4. As shown in FIG. 3, the secondary transfer roller 27 is disposed to face the drive roller 26A across the intermediate transfer belt 26.

As shown in FIG. 4, the size of the secondary transfer roller 27 in the axis direction (the left-right direction D3) is smaller than the width of the intermediate transfer belt 26 (the size in the left-right direction D3). As a result, the outer peripheral surface of the intermediate transfer belt 26 has a non-contact area A3 (see FIG. 4) that does not come in contact with the secondary transfer roller 27. The non-contact area A3 is an area outside a contact area A2 (see FIG. 4) of the outer peripheral surface of the intermediate transfer belt 26 that comes in contact with the secondary transfer roller 27, and the non-contact area A3 includes an end portion of the intermediate transfer belt 26 in the width direction.

The fixing device 28 fixes the toner image transferred to the sheet by the secondary transfer roller 27, to the sheet.

The sheet to which the toner image has been fixed by the fixing device 28 is discharged to the sheet discharge tray 29.

Among the four first power supplies 40, a first power supply 41 (see FIG. 2) is a constant current power supply that supplies the primary transfer current to the primary transfer roller 34 of the image forming unit 21. Among the four first power supplies 40, a first power supply 42 (see FIG. 2) is a constant current power supply that supplies the primary transfer current to the primary transfer roller 34 of the image forming unit 22. Among the four first power supplies 40, a first power supply 43 (see FIG. 2) is a constant current power supply that supplies the primary transfer current to the primary transfer roller 34 of the image forming unit 23. Among the four first power supplies 40, a first power supply 44 (see FIG. 2) is a constant current power supply that supplies the primary transfer current to the primary transfer roller 34 of the image forming unit 24. The first power supplies 40 supply the primary transfer current set by the control portion 7 respectively to the primary transfer rollers 34. For example, the primary transfer current is a current of a negative polarity.

The second power supply 45 is a constant current power supply that supplies the secondary transfer current to the secondary transfer roller 27. The second power supply 45 supplies the secondary transfer current set by the control portion 7 to the secondary transfer roller 27. For example, the secondary transfer current is a current of a negative polarity.

The density sensor 46 detects density of a toner image transferred to the non-contact area A3 (see FIG. 4) on the outer peripheral surface of the intermediate transfer belt 26. For example, the density sensor 46 is a photosensor of a reflection type including a light emitting portion and a light receiving portion, wherein the light emitting portion emits light toward the non-contact area A3 of the intermediate transfer belt 26, and the light receiving portion receives light that was emitted by the light emitting portion and was reflected from the non-contact area A3 of the intermediate transfer belt 26. As shown in FIG. 3, the density sensor 46 is disposed at a position that is downstream, in the belt rotation direction D5, of the transfer position where the toner image is transferred by the secondary transfer roller 27, and upstream, in the belt rotation direction D5, of a cleaning position where the outer peripheral surface of the intermediate transfer belt 26 is cleaned by the belt cleaning portion 26C. The density sensor 46 inputs, to the control portion 7, an electric signal that corresponds to the density of the toner image that is a detection object.

[Configuration of Control Portion 7]

Next, a configuration of the control portion 7 is described with reference to FIG. 2.

As shown in FIG. 2, the control portion 7 includes an acquisition processing portion 51, a transfer processing portion 52, a detection processing portion 53, a correction processing portion 54, and an adjustment processing portion 55.

Specifically, a condition adjustment program for causing the CPU 11 to function as the above-described portions is preliminarily stored in the ROM 12 of the control portion 7. The CPU 11 functions as the above-described portions by executing the condition adjustment program stored in the ROM 12.

It is noted that the condition adjustment program may be recorded on a non-transitory computer-readable recording medium such as a CD, a DVD, or a flash memory, and may be read from the recording medium and installed in a storage device such as the storage portion 6. In addition, a part or all of the acquisition processing portion 51, the transfer processing portion 52, the detection processing portion 53, the correction processing portion 54, and the adjustment processing portion 55 may be composed of an electronic circuit such as an integrated circuit (ASIC).

The acquisition processing portion 51 acquires an electrical resistance of the intermediate transfer belt 26.

For example, the acquisition processing portion 51 acquires an electrical resistance of the intermediate transfer belt 26 by using a voltmeter that can measure a voltage applied to the primary transfer roller 34 of the image forming unit 21.

Specifically, the acquisition processing portion 51 calculates an electrical resistance value based on: a predetermined current value; and a measurement value of the voltmeter when the primary transfer current of the current value is supplied to the primary transfer roller 34 of the image forming unit 21. The acquisition processing portion 51 acquires the calculated electrical resistance value as an electrical resistance of the intermediate transfer belt 26. It is noted that the acquisition processing portion 51 may acquire, as the electrical resistance of the intermediate transfer belt 26, an average value of a plurality of calculated electrical resistance values corresponding to a plurality of primary transfer currents of different current values.

For example, the acquisition processing portion 51 acquires the electrical resistance of the intermediate transfer belt 26 when a print process is executed to print an image based on image data.

The transfer processing portion 52 transfers predetermined detection toner images X10 (see FIG. 4) to outside an output area A1 (see FIG. 4) of the intermediate transfer belt 26 to which a toner image as an output target is transferred from the photoconductor drum 31. It is noted that in FIG. 4, the detection toner images X10 are hatched portions.

Specifically, the output area A1 is inside the contact area A2 (see FIG. 4) on the outer peripheral surface of the intermediate transfer belt 26. For example, the output area A1 is an area of the outer peripheral surface of the intermediate transfer belt 26 that comes in contact with the sheet used in printing.

For example, the transfer processing portion 52 transfers the detection toner images X10 to the non-contact area A3 (see FIG. 4) of the outer peripheral surface of the intermediate transfer belt 26. With this configuration, there is no need to provide a cleaning portion that removes the detection toner images X10 that have adhered to the secondary transfer roller 27, from the secondary transfer roller 27, thereby making it possible to simplify the configuration compared to a configuration where the detection toner images X10 are transferred to the contact area A2 of the intermediate transfer belt 26.

It is noted that the transfer processing portion 52 may transfer the detection toner images X10 to an area that is outside the output area A1 (see FIG. 4) and is inside the contact area A2 (see FIG. 4) of the intermediate transfer belt 26. In this case, the density sensor 46 may be disposed at a position that is downstream, in the belt rotation direction D5, of the photoconductor drum 31 of the image forming unit 24, and upstream, in the belt rotation direction D5, of the transfer position where the toner image is transferred by the secondary transfer roller 27.

In addition, the transfer processing portion 52 transfers a plurality of detection toner images X10 that correspond to the plurality of image forming units 20.

Among the plurality of detection toner images X10, a detection toner image X11 (see FIG. 4) corresponding to the image forming unit 21 is a Y (yellow) toner image that is formed by the image forming unit 21 based on a predetermined first detection image. The first detection image is a Y (yellow) single-color image having a predetermined density. For example, the first detection image is a rectangular image (see FIG. 4).

Among the plurality of detection toner images X10, a detection toner image X12 (see FIG. 4) corresponding to the image forming unit 22 is a C (cyan) toner image that is formed by the image forming unit 22 based on a predetermined second detection image. The second detection image is a C (cyan) single-color image having a predetermined density. For example, the second detection image is a rectangular image (see FIG. 4) like the first detection image.

Among the plurality of detection toner images X10, a detection toner image X13 (see FIG. 4) corresponding to the image forming unit 23 is a M (magenta) toner image that is formed by the image forming unit 23 based on a predetermined third detection image. The third detection image is a M (magenta) single-color image having a predetermined density. For example, the third detection image is a rectangular image (see FIG. 4) like the first detection image.

Among the plurality of detection toner images X10, a detection toner image X14 (see FIG. 4) corresponding to the image forming unit 24 is a K (black) toner image that is formed by the image forming unit 24 based on a predetermined fourth detection image. The fourth detection image is a K (black) single-color image having a predetermined density. For example, the fourth detection image is a rectangular image (see FIG. 4) like the first detection image.

For example, the transfer processing portion 52 transfers the plurality of detection toner images X10 to the intermediate transfer belt 26 when a predetermined adjustment timing comes during an execution of the print process. For example, the adjustment timing is a timing when the number of prints printed during the print process has reached a multiple of a predetermined first reference number. It is noted that the adjustment timing may be a timing when the accumulated number of prints printed in the image forming apparatus 100 has reached a multiple of a predetermined second reference number. In addition, the adjustment timing may be a timing that comes at predetermined time intervals during an execution of the print process.

For example, when the adjustment timing has come, the transfer processing portion 52 draws the first detection image, the second detection image, the third detection image, and the fourth detection image in an area in image data to be input to the optical scan device 25 next, the area corresponding to the non-contact area A3 (see FIG. 4).

The detection processing portion 53 detects the density of each of the detection toner images X10 transferred to the intermediate transfer belt 26 by the primary transfer rollers 34.

Specifically, the detection processing portion 53 detects, by using the density sensor 46, the density of each of the detection toner images X10 transferred to the non-contact area A3 (see FIG. 4) of the intermediate transfer belt 26.

Meanwhile, in a conventional image forming apparatus, an image forming condition is adjusted based on the detected density of the detection toner images X10 transferred to the intermediate transfer belt 26.

Here, the transfer efficiency with which the primary transfer roller 34 transfers the detection toner image X10 changes in response to an amount of toner that is transferred from the photoconductor drum 31 to the output area A1 of the intermediate transfer belt 26 at a transfer timing when the primary transfer roller 34 transfers the detection toner image X10.

Specifically, the larger the amount of the toner transferred from the photoconductor drum 31 to the output area A1 at the transfer timing is, the higher the transfer efficiency with which the primary transfer roller 34 transfers the toner image including the detection toner image X10 is. This is because the larger the amount of the toner transferred from the photoconductor drum 31 to the output area A1 at the transfer timing is, the narrower a non-exposure area (an area to which the light from the optical scan device 25 is not irradiated) of the photoconductor drum 31 that faces the primary transfer roller 34 at the timing is. The transfer current flows more easily through the non-exposure area than an exposure area of the photoconductor drum 31. As a result, as the non-exposure area of the photoconductor drum 31 facing the primary transfer roller 34 becomes narrower, the current density of the transfer current that flows via the exposure area increases, and thus the transfer efficiency increases.

However, in the conventional image forming apparatus, the change of the transfer efficiency of the detection toner image X10 in response to the amount of the toner transferred from the photoconductor drum 31 to the output area A1 at the transfer timing is not taken into consideration. Due to this, the conventional image forming apparatus cannot adjust the image forming condition accurately.

On the other hand, as described in the following, the image forming apparatus 100 according to the embodiment of the present disclosure can adjust the image forming condition accurately.

The correction processing portion 54 corrects the detection result of the detection processing portion 53 based on the amount of the toner transferred from the photoconductor drum 31 to the output area A1 of the intermediate transfer belt 26 at the transfer timing when the primary transfer roller 34 transfers the detection toner image X10.

Specifically, the correction processing portion 54 corrects the detection result based on the amount of the toner transferred from the photoconductor drum 31 to the output area A1 of the intermediate transfer belt 26 at the transfer timing, the amount of the toner being acquired based on the image data corresponding to the toner image as the output target.

In addition, the correction processing portion 54 corrects the detection result based on: the amount of the toner transferred from the photoconductor drum 31 to the output area A1 at the transfer timing; and the electrical resistance of the intermediate transfer belt 26 acquired by the acquisition processing portion 51.

For example, the correction processing portion 54 calculates, based on the image data corresponding to the toner image as the output target, the amount of the toner transferred from the photoconductor drum 31 to the output area A1 at the transfer timing.

In addition, the correction processing portion 54 acquires, based on the calculated amount of toner, a correction coefficient that is used to correct the detection result.

For example, in the image forming apparatus 100, first table data is preliminarily stored in the ROM 12, wherein the first table data indicates correlation between: the amount of the toner transferred from the photoconductor drum 31 to the output area A1 of the intermediate transfer belt 26 at the transfer timing; and the correction coefficient. For example, the first table data defines the correlation between the amount of the toner and the correction coefficient such that the larger the amount of the toner transferred from the photoconductor drum 31 to the output area A1 at the transfer timing is, the smaller the correction coefficient is in a range of larger than 0 and equal to or smaller than 1.

The correction processing portion 54 acquires, by using the first table data, a correction coefficient corresponding to the calculated amount of toner.

It is noted that the correction processing portion 54 may acquire the correction coefficient corresponding to the calculated amount of toner, by using a predetermined formula that indicates relationship between: the amount of the toner transferred from the photoconductor drum 31 to the output area A1 of the intermediate transfer belt 26 at the transfer timing; and the correction coefficient.

In addition, the correction processing portion 54 modifies the correction coefficient based on the electrical resistance of the intermediate transfer belt 26 acquired by the acquisition processing portion 51.

For example, in the image forming apparatus 100, second table data is preliminarily stored in the ROM 12, wherein the second table data indicates correlation between the electrical resistance of the intermediate transfer belt 26 and a modification value that is used to modify the correction coefficient. For example, in the second table data, it is defined that the modification value is 0 when the electrical resistance of the intermediate transfer belt 26 is a predetermined reference value. In addition, in the second table data, correlation between the electrical resistance of the intermediate transfer belt 26 and the modification value is defined such that the larger the electrical resistance of the intermediate transfer belt 26 is in excess of the reference value, the larger the modification value is in a minus direction. In addition, in the second table data, correlation between the electrical resistance of the intermediate transfer belt 26 and the modification value is defined such that the smaller the electrical resistance of the intermediate transfer belt 26 is below the reference value, the larger the modification value is in a plus direction.

The correction processing portion 54 acquires, by using the second table data, a modification value corresponding to the electrical resistance of the intermediate transfer belt 26 acquired by the acquisition processing portion 51. In addition, the correction processing portion 54 modifies the correction coefficient by adding the acquired modification value to the acquired correction coefficient.

Subsequently, the correction processing portion 54 corrects the detection result by multiplying the detection result of the detection processing portion 53 by the modified correction coefficient.

It is noted that the image forming apparatus 100 may include an imaging portion configured to image a toner image formed on the outer peripheral surface of the intermediate transfer belt 26, at a position that is downstream, in the belt rotation direction D5, of the photoconductor drum 31 of the image forming unit 24 and upstream, in the belt rotation direction D5, of the transfer position where the toner image is transferred by the secondary transfer roller 27. In this case, the correction processing portion 54 may use the imaging portion to acquire the amount of the toner transferred from the photoconductor drum 31 to the output area A1 of the intermediate transfer belt 26 at the transfer timing.

In addition, the correction processing portion 54 may correct the detection result based on only the amount of the toner transferred from the photoconductor drum 31 to the output area A1 of the intermediate transfer belt 26 at the transfer timing. In this case, the control portion 7 may not include the acquisition processing portion 51.

The adjustment processing portion 55 adjusts the image forming condition based on the detection result after correction by the correction processing portion 54.

For example, when a difference between the detection result after correction by the correction processing portion 54 and a predetermined reference density is smaller than a predetermined threshold, the adjustment processing portion 55 adjusts, based on the difference, the amount of light emitted from the optical scan device 25. In addition, when the difference between the detection result after correction by the correction processing portion 54 and the reference density is equal to or larger than the threshold, the adjustment processing portion 55 stops the print process, and adjusts the developing bias voltage based on the difference. For example, the reference density is the detection result after correction by the correction processing portion 54 that was acquired during the adjustment of the image forming condition just before.

It is noted that the image forming condition may not be limited to the amount of light emitted from the optical scan device 25, or the developing bias voltage. For example, the image forming condition may include the charging voltage, the primary transfer current, and the secondary transfer current.

[Condition Adjustment Process]

In the following, with reference to FIG. 6, a description is given of an example of the procedure of a condition adjustment process executed by the control portion 7 in the image forming apparatus 100, as well as an image forming condition adjustment method of the present disclosure. Here, steps S11, S12, . . . represent numbers assigned to the processing procedures (steps) executed by the control portion 7. It is noted that when the print job is executed, the condition adjustment process is executed together with the print job.

<Step S11>

First, in step S11, the control portion 7 acquires the electrical resistance of the intermediate transfer belt 26. Here, the process of step S11 is executed by the acquisition processing portion 51 of the control portion 7.

Specifically, the control portion 7 acquires the electrical resistance of the intermediate transfer belt 26 by using the voltmeter.

It is noted that the process of step S11 only needs to be executed before a toner image corresponding to the first image to be printed in the print process, is transferred to the intermediate transfer belt 26. In addition, the process of step S11 may be executed each time it is determined in step S13 that the adjustment timing has come.

It is noted that before a toner image corresponding to the first image to be printed in the print process is transferred to the intermediate transfer belt 26, a current adjustment process for adjusting the primary transfer current may be executed for each of the plurality of image forming units 20. In the current adjustment process, the primary transfer current is adjusted based on the density, detected by the density sensor 46, of each of a plurality of current adjustment toner images for which different primary transfer currents are used in the primary transfer. Specifically, in the current adjustment process, the primary transfer current is adjusted so that the quantity of density change of the current adjustment toner image when the primary transfer current has changed by a predetermined value, is equal to or smaller than a predetermined allowable value. With this configuration where the current adjustment process is executed for each of the plurality of image forming units 20, it is possible to adjust the image forming condition more accurately during the execution of the print process.

<Step S12>

In step S12, the control portion 7 determines whether or not the print process has ended.

Here, upon determining that the print process has ended (Yes at step S12), the control portion 7 ends the condition adjustment process. In addition, upon determining that the print process has not ended (No at step S12), the control portion 7 moves the process to step S13.

<Step S13>

In step S13, the control portion 7 determines whether or not the adjustment timing has come.

Specifically, when the number of prints printed during the print process has reached a multiple of the first reference number, the control portion 7 determines that the adjustment timing has come.

Here, upon determining that the adjustment timing has come (Yes at step S13), the control portion 7 moves the process to step S14. In addition, upon determining that the adjustment timing has not come (No at step S13), the control portion 7 moves the process to step S12.

<Step S14>

In step S14, the control portion 7 transfers a plurality of detection toner images X10 (see FIG. 4) that correspond to the plurality of image forming units 20, to outside the output area A1 (see FIG. 4) of the intermediate transfer belt 26. Here, the process of step S14 is an example of a transfer step of the present disclosure, and is executed by the transfer processing portion 52 of the control portion 7.

Specifically, the control portion 7 draws the first detection image, the second detection image, the third detection image, and the fourth detection image in an area that corresponds to the non-contact area A3 (see FIG. 4), in image data to be input to the optical scan device 25 next. This allows the detection toner images X10 corresponding to the image forming units 20 to be formed in the image forming units 20, respectively. In addition, the detection toner images X10 formed in the image forming units 20 are transferred to the intermediate transfer belt 26.

<Step S15>

In step S15, the control portion 7 detects the density of each of the detection toner images X10 transferred in step S14. Here, the process of step S15 is an example of a detection step of the present disclosure, and is executed by the detection processing portion 53 of the control portion 7.

Specifically, the control portion 7 detects, by using the density sensor 46, the density of each of the detection toner images X10 transferred to the non-contact area A3 (see FIG. 4) of the intermediate transfer belt 26.

<Step S16>

In step S16, the control portion 7 calculates, for each of the image forming units 20, the amount of the toner transferred from the photoconductor drum 31 to the output area A1 of the intermediate transfer belt 26 at the transfer timing when the detection toner image X10 is transferred by the primary transfer roller 34.

Specifically, the control portion 7 calculates, based on the image data corresponding to the toner image as the output target, the amount of the toner transferred from the photoconductor drum 31 to the output area A1 of the intermediate transfer belt 26 at the transfer timing.

It is noted that the process of step S16 may be executed before the process of step S14.

<Step S17>

In step S17, the control portion 7 corrects the density of each of the detection toner images X10 detected in step S15 based on the electrical resistance of the intermediate transfer belt 26 acquired in step S11 and the amount of toner acquired in step S16. Here, the process of step S17 is an example of a correction step of the present disclosure, and is executed by the correction processing portion 54 of the control portion 7.

Specifically, the control portion 7 acquires the correction coefficient for each of the image forming units 20 based on the amount of toner for each of the image forming units 20 acquired in step S16. In addition, the control portion 7 modifies the acquired correction coefficient for each of the image forming units 20 based on the electrical resistance of the intermediate transfer belt 26 acquired in step S11. In addition, the control portion 7 corrects the density of each of the detection toner images X10 detected in step S15 by using the modified correction coefficient for each of the image forming units 20.

<Step S18>

In step S18, the control portion 7 adjusts the image forming condition for each of the image forming units 20 based on the density of each of the detection toner images X10 corrected in step S17.

Specifically, when a difference between the density of the detection toner image X10 corrected in step S17 and the reference density is smaller than the threshold, the control portion 7 adjusts, based on the difference, the amount of light emitted from the optical scan device 25. In addition, when the difference between the density of the detection toner image X10 corrected in step S17 and the reference density is equal to or larger than the threshold, the control portion 7 stops the print process and adjusts the developing bias voltage based on the difference.

As described above, in the image forming apparatus 100, the detected density of the detection toner image X10 is corrected based on the amount of the toner that is transferred from the photoconductor drum 31 to the output area A1 of the intermediate transfer belt 26 at the transfer timing when the primary transfer roller 34 transfers the detection toner image X10. In addition, the image forming condition is adjusted based on the detected density after correction. This makes it possible to restrict the change of the adjustment result of the image forming condition that is caused by the change of the amount of the toner transferred from the photoconductor drum 31 to the output area A1 at the transfer timing. Thus, it is possible to adjust the image forming condition accurately.

In addition, in the image forming apparatus 100, the detected density of the detection toner image X10 is corrected based on both: the electrical resistance of the intermediate transfer belt 26 that is acquired each time the print process is executed; and the amount of the toner transferred from the photoconductor drum 31 to the output area A1 of the intermediate transfer belt 26 at the transfer timing. With this configuration, it is possible to restrict the change of the detected density of the detection toner image X10 that is caused by the change of the electrical resistance of the intermediate transfer belt 26 that occurs due to, for example, an environmental change and a deterioration over time. Thus, it is possible to adjust the image forming condition more accurately.

It is noted that the transfer portion of the present disclosure may be the secondary transfer roller 27. In this case, the secondary transfer current is another example of the transfer current of the present disclosure. In addition, the intermediate transfer belt 26 is another example of the image-carrying member of the present disclosure. In addition, the sheet is another example of the transfer object of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a transfer portion configured to, upon receiving a supply of a predetermined transfer current, transfer a toner image formed on an image-carrying member to a transfer object;

a transfer processing portion configured to transfer a predetermined detection toner image to outside an output area of the transfer object to which the toner image as an output target is transferred from the image-carrying member;

a detection processing portion configured to detect a density of the detection toner image that has been transferred to the transfer object by the transfer processing portion;

a correction processing portion configured to correct a detection result of the detection processing portion based on an amount of toner transferred from the image-carrying member to the output area at a transfer timing when the transfer processing portion transfers the detection toner image; and an adjustment processing portion configured to adjust an image forming condition based on the detection result after correction by the correction processing portion.

2. The image forming apparatus according to claim 1, further comprising an acquisition processing portion configured to acquire an electrical resistance of the transfer object, wherein the correction processing portion corrects the detection result based on: the amount of the toner transferred from the image-carrying member to the output area at the transfer timing; and the electrical resistance of the transfer object acquired by the acquisition processing portion.

3. The image forming apparatus according to claim 1, wherein the correction processing portion corrects the detection result based on the amount of the toner transferred from the image-carrying member to the output area at the transfer timing, the amount of the toner being acquired based on image data corresponding to the toner image as the output target.

4. The image forming apparatus according to claim 1, wherein

The transfer object is an image conveying member that conveys the toner image transferred from the image-carrying member, to a transfer position where the toner image is transferred to a sheet.

5. An image forming condition adjustment method executed in an image forming apparatus including a transfer portion configured to, upon receiving a supply of a predetermined transfer current, transfer a toner image formed on an image-carrying member to a transfer object, the mage forming condition adjustment method comprising:

a transfer step of transferring a predetermined detection toner image to outside an output area of the transfer object to which the toner image as an output target is transferred from the image-carrying member;

a detection step of detecting a density of the detection toner image that has been transferred to the transfer object by the transfer step;

a correction step of correcting a detection result of the detection step based on an amount of toner transferred from the image-carrying member to the output area at a transfer timing when the transfer step transfers the detection toner image; and an adjustment step of adjusting an image forming condition based on the detection result after correction by the correction step.

* * * * *